US006732858B1

(12) United States Patent
Chang Ou

(10) Patent No.: US 6,732,858 B1
(45) Date of Patent: May 11, 2004

(54) SHOE STORAGE BOX

(76) Inventor: Shu-Mei Chang Ou, No. 22, Lane 215, Shui-Yuan Rd., Feng Yuan City, Taichung Hsien (TW)

( * ) Notice: Subject to any disclaimer, the term of this patent is extended or adjusted under 35 U.S.C. 154(b) by 0 days.

(21) Appl. No.: 10/345,490

(22) Filed: Jan. 17, 2003

(51) Int. Cl.[7] ..... B65D 85/18; B65D 21/00; B65D 85/62

(52) U.S. Cl. ..... 206/278; 206/509; 206/516; 220/6; 220/23.6

(58) Field of Search ..... 220/6, 4.28, 23.6; 206/278, 504, 509, 512, 516, 517

(56) References Cited

U.S. PATENT DOCUMENTS 2,593,998 A * 4/1952 Dupuis ..... 206/509
2,676,861 A * 4/1954 Belew ..... 220/23.6
3,028,207 A * 4/1962 Darnell ..... 206/509
3,030,163 A * 4/1962 Gottsegen ..... 206/509
3,918,781 A * 11/1975 Paris ..... 206/509
4,235,346 A * 11/1980 Liggett ..... 220/7
4,819,795 A * 4/1989 Swaney ..... 206/278
4,998,637 A * 3/1991 Marovskis ..... 220/6
5,316,165 A * 5/1994 Moran, Jr. ..... 220/62
5,509,170 A * 4/1996 LoFaro et al. ..... 15/265
5,666,743 A * 9/1997 Dawson ..... 34/219

* cited by examiner

*Primary Examiner*—Tri M. Mai
(74) *Attorney, Agent, or Firm*—Rosenberg, Klein & Lee

(57) ABSTRACT

A shoe storage box includes a bottom board, a first side board, a top board, a second side board, a rear board and a front board. A V-shaped notch is formed at a joint between each of the bottom board and the first side board, the first side board and the top board, the bottom board and the rear board such that the first side board is able to be vertical to the bottom board, the top board is vertical to the first side board, and the rear board is able to be vertical to the bottom board. A ventilation layer is received in the shoe storage box so that air circulation between inside and outside the shoe storage box is secured.

4 Claims, 6 Drawing Sheets

SHOE STORAGE BOX

BACKGROUND OF THE INVENTION

1. Field of the Invention

The present invention relates to a shoe storage box, and more particularly to a shoe storage box which is collapsible and has a ventilation layer so that air inside the shoe storage box is able to have good air circulation with ambient air.

2. Description of Related Art

With reference to FIG. 6, a conventional shoe storage box has a hollow body (90) with a front open end and a rear open end and a cover (91) pivotally connected to a side face defining the front open end. Each of two opposite outer side surfaces adjacent to the side face which connects to the cover (91) is provided with dovetailed protrusions (92) and dovetailed recesses (93) each defined adjacent to one of the dovetailed protrusions (92). A vent (94) is provided in the cover (91). When the shoe storage box is to be combined with another shoe storage box, the user just slides the dovetailed protrusions (92) in the corresponding dovetailed recesses in another shoe storage box. After the dovetailed protrusions (92) are fully received in the dovetailed recesses (93), the combination between two shoe boxes is finished. With the pivotal movement of the cover (91), the user is able to store shoes inside the hollow body (90). Further, due to the vent (94), air inside the hollow body (90) is able to circulate with the ambient air outside the shoe storage box.

However, to have a stable support to the shoe storage box, the user normally places the shoe storage box against a wall, which stops the air circulation of the shoe storage box. Therefore, the odor and moisture of the shoes inside the shoe storage box is contained inside the shoe storage box and can not be dissipated.

To overcome the shortcomings, the present invention tends to provide an improved shoe storage box to mitigate and obviate the aforementioned problems.

SUMMARY OF THE INVENTION

The primary objective of the present invention is to provide an improved shoe storage box to allow air circulation under any circumstances.

Another objective of the present invention is to provide an improved shoe storage box having a ventilation layer inside the shoe storage box to filter out odor from the shoes such that even when the shoe storage box is placed indoors, the air will not be polluted.

Other objects, advantages and novel features of the invention will become more apparent from the following detailed description when taken in conjunction with the accompanying drawings.

DETAILED DESCRIPTION OF THE PREFERRED EMBODIMENT

Figure 1:
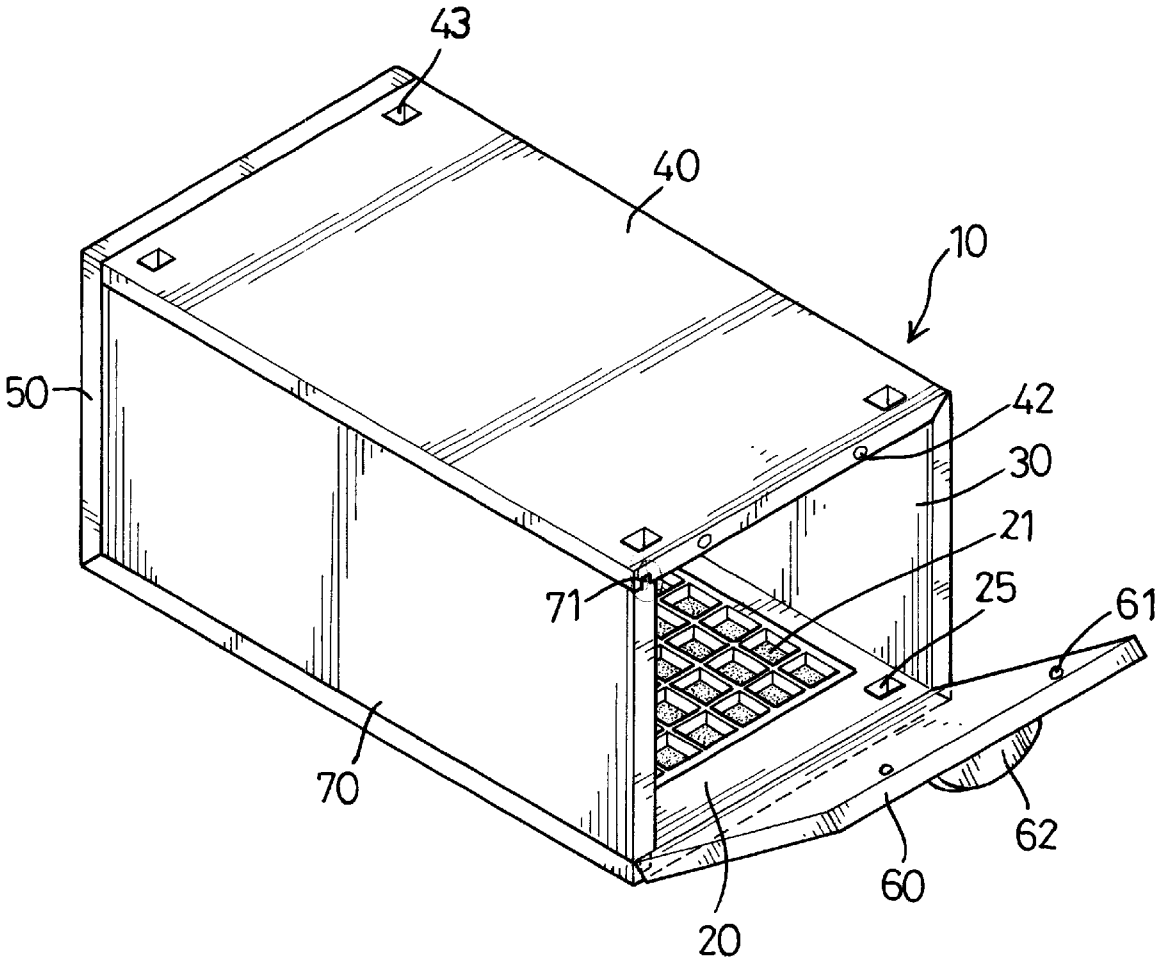
FIG. 1 is a perspective view of the shoe storage box of the present invention.

With reference to FIG. 1, the shoe storage box (10) in accordance with the present invention includes a bottom board (20), a first side board (30), a top board (40), a rear board (50), a front board (60) and a second side board (70).

Figure 2:
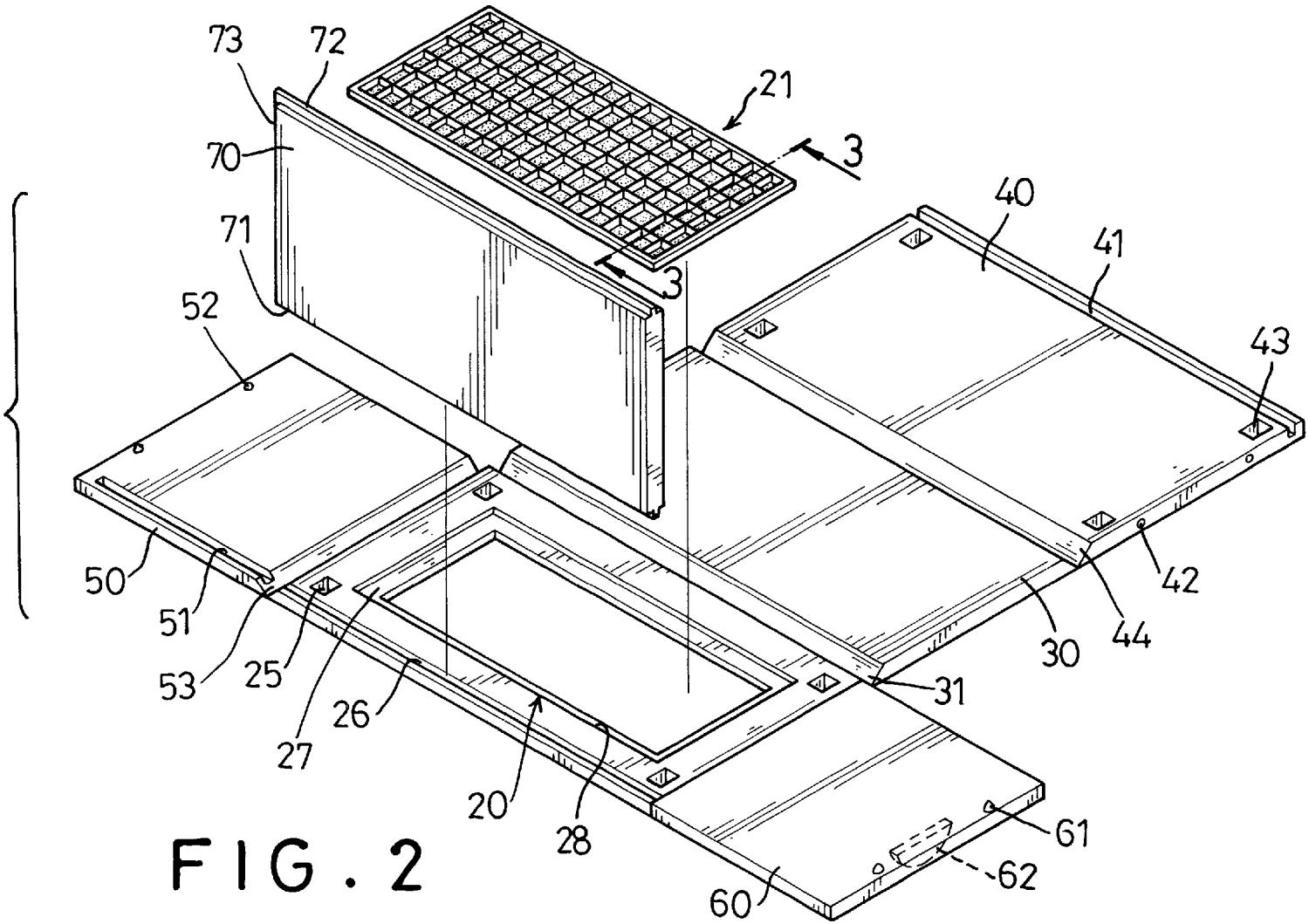
FIG. 2 is an exploded perspective view of the shoe storage box in FIG. 1.

With reference to FIG. 2 and still taking FIG. 1 for reference, the bottom board (20) is rectangular and has a first assembly hole (25) defined in each of four comers of the bottom board (20), a first groove (26) defined in one side of the bottom board (20) and a central hole (28) defined in a center of the bottom board (20) and enclosed by a step (27).

The first side board (30) is securely connected to a side of the bottom board (20). In order to have a smooth assembly connection, a V-shaped notch (31) is defined at a joint between the bottom board (20) and the side face of the first side board (30).

The top board (40) is securely connected to a side of the first side board (30) and has a second groove (41) defined in a side away from a joint between the top board (40) and the first side board (30), a pair of apertures (42) defined in opposite edges adjacent to the side face with the second groove (41) and a second assembly hole (43) defined in each of four comers of the top board (40). Again, in order to have a smooth assembly connection, a second V-shaped notch (44) is defined at a joint between the first side board (30) and the top board (40).

The rear board (50) is securely connected to the bottom board (20) and has a third groove (51) defined in a side face of the rear board (50) and a pair of bosses (52) formed on a side face opposite to the side face connecting to the bottom board (20). In order to have a smooth assembly connection, a third V-shaped notch (53) is defined at a joint between the bottom board (20) and the rear board (50).

The front board (60) is connected to the bottom board (20) and has a pair of second bosses (61) formed on a side face opposite to a side face connecting to the bottom board (20) and a handle (62) formed on a bottom face of the front board (60).

The second side board (70) has a first ridge (71) formed on an edge of the second side board (70) to correspond to the first groove (26) of the bottom board (20), a second ridge (72) formed on an edge of the second side board (70) to correspond to the second groove (41) of the top board (40) and a third ridge (73) formed on an edge of the second side board (70) to correspond to the third groove (51) of the rear board (50).

Figure 3:
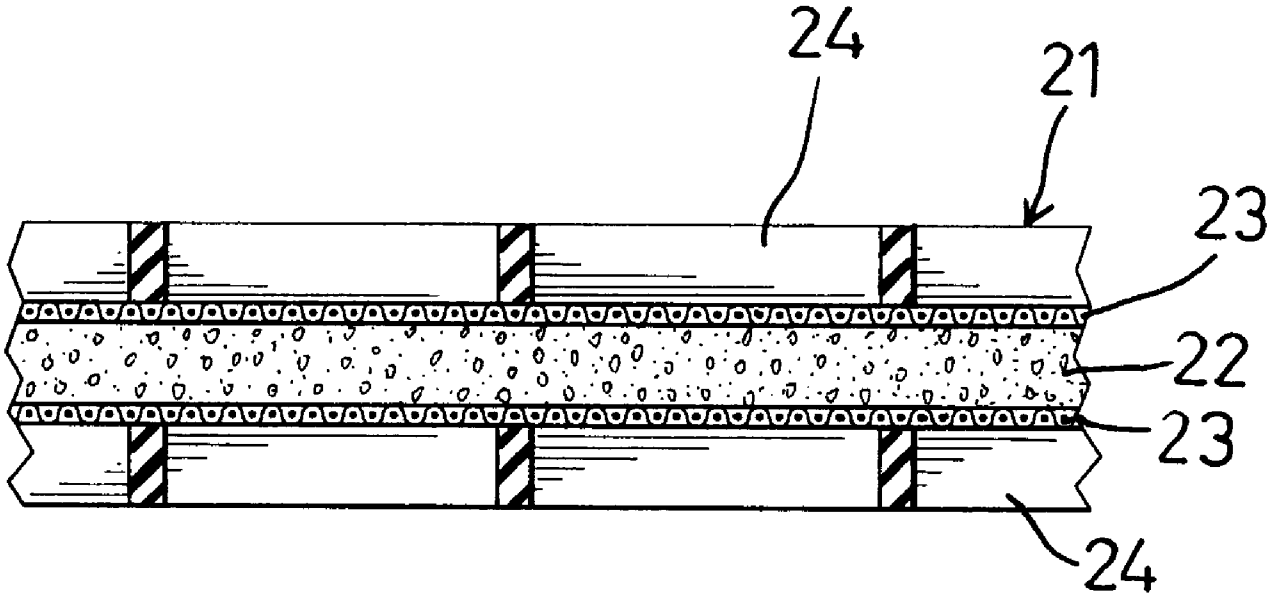
FIG. 3 is a cross section of the ventilation layer used inside the shoe storage box in FIG. 1.

With reference to FIG. 3, a ventilation layer (21) is so formed that the ventilation layer (21) is supported by the step (27) in the bottom board (20). The ventilation layer (21) is composed of an active carbon layer (22), a fiber layer (23) provided on opposite faces of the active carbon layer (22) and a grid (24) provided on an outer side face of the fiber layer (23) on the opposite faces of the active carbon layer (22).

When the shoe storage box (10) of the present invention is to be assembled, the user first inserts the first ridge (71) in the corresponding first groove (26) of the bottom board (20). Then the first side board (30) and the rear board (50) are erected to have the third ridge (73) received in the third groove (51). After the first side board (30) is erected, the top board (40) is then folded to be vertical to the first side board

(30) such that the second ridge (72) is able to be received in the corresponding second groove (41). Thereafter, the ventilation layer (21) is placed inside the space defined by the bottom board (20), the first side board (30), the top board (40), the rear board (50) and the second side board (70).

After the foregoing assembly process, the user is then able to place shoes inside the shoe storage box. When the shoes are placed inside the shoe storage box, the user is able to use the handle (62) to close the shoe storage box. Because of the ventilation layer (21) inside the shoe storage box, the odor and moisture from the shoes are able to be dissipated.

Figure 4:
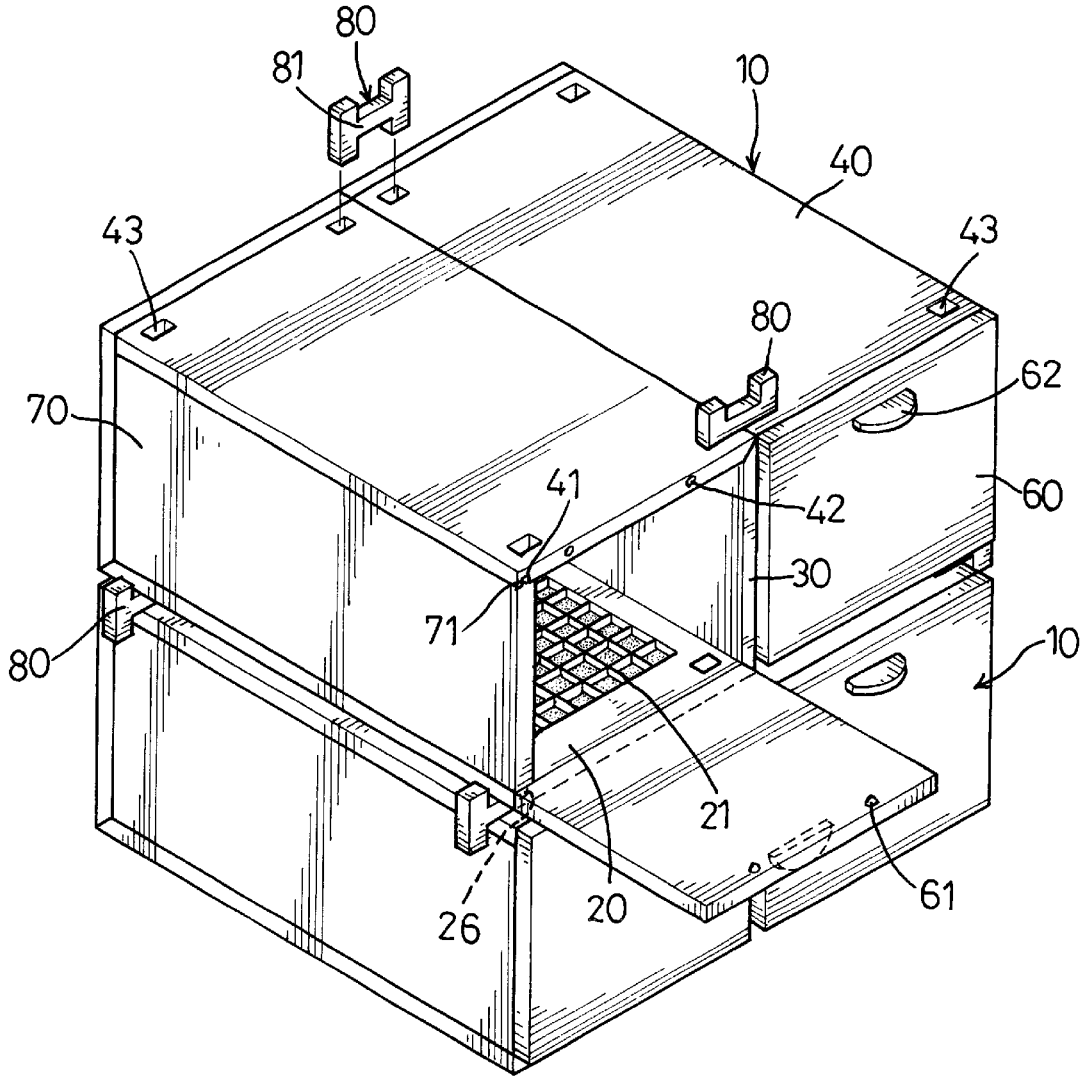
FIG. 4 is a perspective view showing that the shoe storage box is combined with other shoe storage boxes by connectors.
Figure 5:
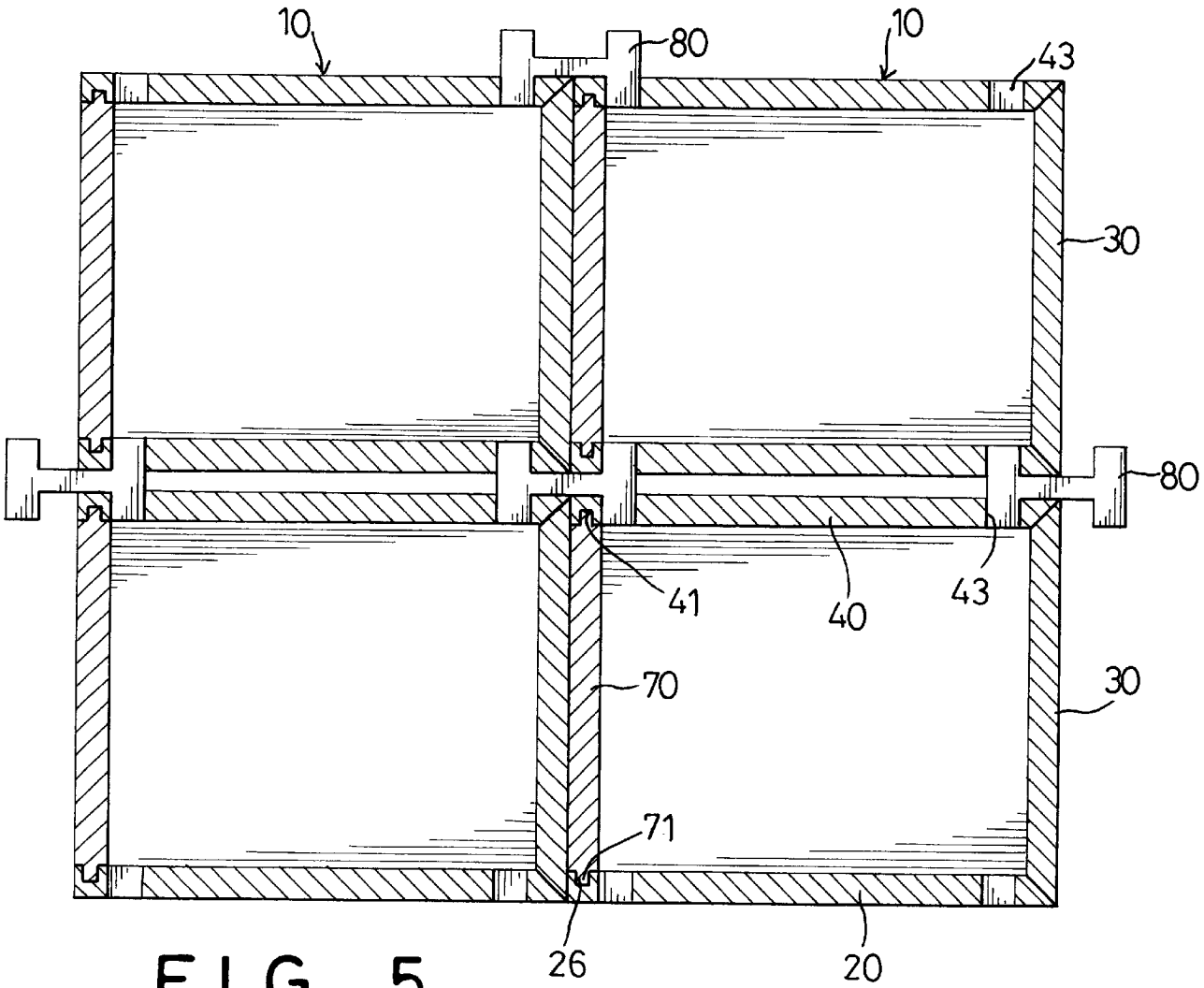
FIG. 5 is a cross sectional view taken from line 5—5 in FIG. 4.
Figure 6:
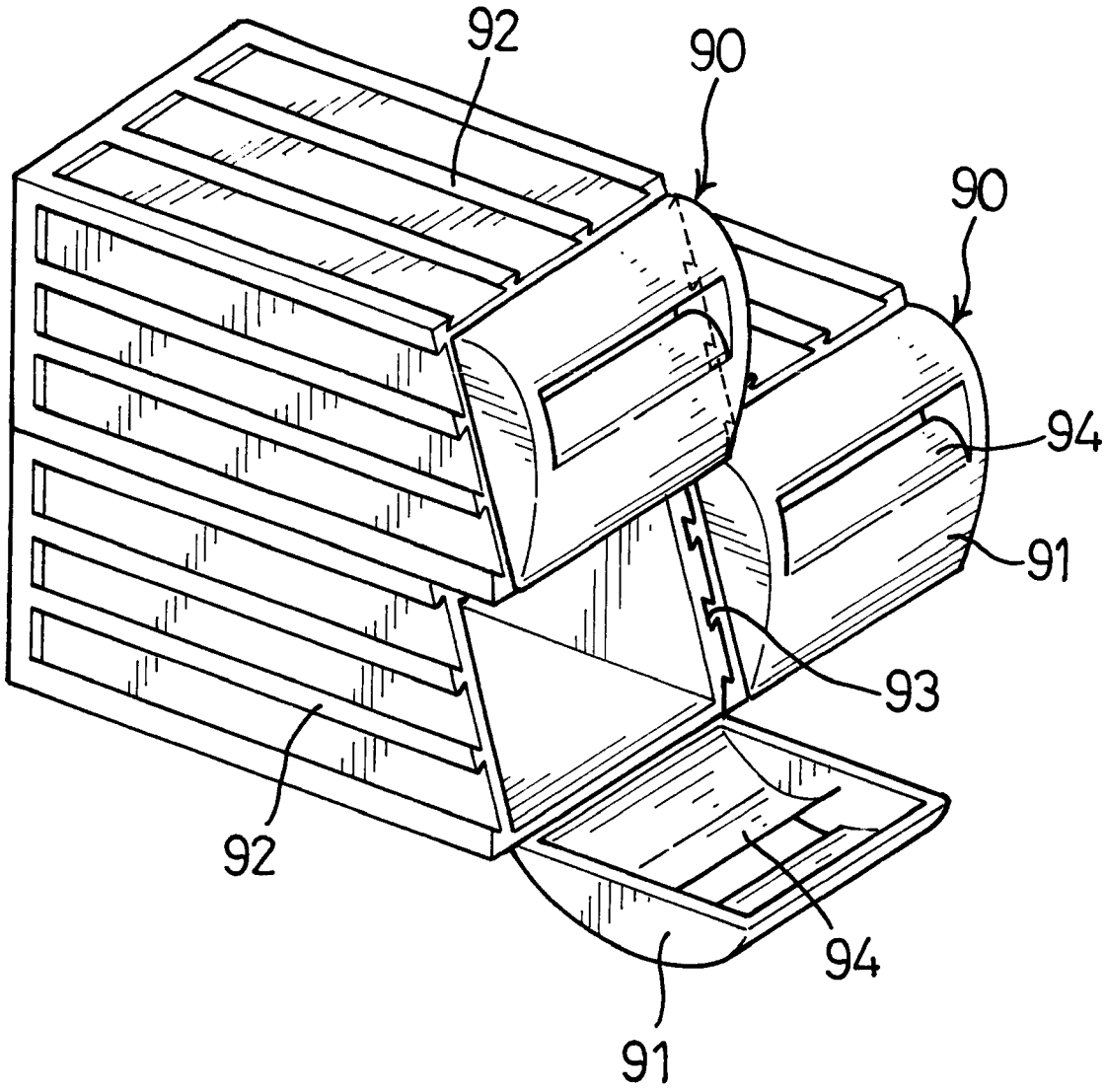
FIG. 6 PRIOR ART
FIG. 6 is a perspective view of a conventional shoe storage box.

With reference to FIGS. 4 and 5, the shoe storage box of the present invention further has an H-shaped connector (80). When two shoe storage boxes (10) are to be combined (four are shown to be combined in the drawings), the user is able to use one distal end of the H-shaped connector (80) to extend into one of the four second assembly holes (43) in one of the two shoe storage boxes (10) and the other distal end of the H-shaped connector (80) to extend into one of the four second assembly holes (43) in the other shoe storage box (10). When two H-shaped connectors (80) are used to combine two shoe storage boxes (10) by combining adjacent second assembly holes (43) from two adjacent shoe storage boxes (10), the two shoe storage boxes (10) are securely connected to one another.

If more shoe storage boxes (10) are to be connected to the combination of the two shoe storage boxes (10), the free two distal ends of the H-shaped connector (80) are inserted into adjacent two first assembly holes (25) of the bottom boards (20) of two adjacent shoe storage boxes (10) so as to combine further two shoe storage boxes (10) with the combination of the two shoe storage boxes (10). Because the H-shaped connector (80) has a cross bar (81) separating a top shoe storage box (10) from a bottom shoe storage box (10), air inside the shoe storage box (10) is still able to circulate and exchange with air outside the shoe storage box (10) through the ventilation layer (21).

To summarize the advantage of the shoe storage box of the present invention, it is noted that because the shoe storage box is collapsible, the storage quantity is increased and thus the cost for the warehouse storage is relatively reduced. Furthermore, due to the compact size of the shoe storage box when collapsed, the shipment quantity is increased and thus the shipment cost is relatively reduced.

When the shoe storage box (10) is stacked on top of another shoe storage box (10), due to the H-shaped connector (80), the combination between the two shoe storage boxes (10) is secured and the air inside the shoe storage boxes (10) and outside the shoe storage boxes (10) still circulates.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A shoe storage box comprising:

a bottom board having a first groove defined in one side of the bottom board and a central hole defined in a center of the bottom board and enclosed by a step;

a first side board securely connected to a side of the bottom board and having a V-shaped notch defined at a joint between the bottom board and a side face of the first side board;

a top board securely connected to a side of the first side board to be vertical relative to the first side board, the top board having a second groove defined in a side away from a joint between the top board and the first side board and a second V-shaped notch defined at a joint between the first side board and the top board;

a rear board securely connected to the bottom board and having a third groove defined in a side face of the rear board and a third V-shaped notch defined at a joint between the bottom board and the rear board;

a front board pivotally connected to the bottom board; and a second side board having a first ridge formed on an edge of the second side board to correspond to the first groove of the bottom board, a second ridge formed on an edge of the second side board to correspond to the second groove of the top board and a third ridge formed on an edge of the second side board to correspond to the third groove of the rear board, wherein a ventilation layer is so formed that the ventilation layer is supported by the step and on top of the central hole of the bottom board, the ventilation layer is composed of an active carbon layer, a fiber layer provided on opposite faces of the active carbon layer and a grid provided on an outer side face of the fiber layer on the opposite faces of the active carbon layer, whereby after the first ridge is received in the first groove, the second ridge is received in the second groove and the third ridge is received in the third groove, the shoe storage box is assembled.

2. The shoe storage box as claimed in claim 1 further comprising an H-shaped connector, wherein the top board has a first assembly hole defined in four corners of the top board such that when two shoe storage boxes are to be combined, the H-shaped connector is able to secure connection between the two adjacent shoe storage boxes by inserting two adjacent distal ends of the H-shaped connector to two adjacent first assembly holes of two shoe storage boxes.

3. The shoe storage box as claimed in claim 2, wherein the bottom board further has a second assembly hole defined in four comers of the bottom board such that the H-shaped connector is able to secure connection between the two adjacent shoe storage boxes by inserting the other two adjacent distal ends of the H-shaped connector to two adjacent second assembly holes of two shoe storage boxes.

4. The shoe storage box as claimed in claim 3, wherein the front board further has a handle provided on a face of the front board to facilitate opening and closing of the shoe storage box.

* * * * *